US008898053B2

(12) United States Patent
Oshikiri

(10) Patent No.: US 8,898,053 B2
(45) Date of Patent: Nov. 25, 2014

(54) ENCODING DEVICE, DECODING DEVICE, AND METHODS THEREIN

(75) Inventor: Masahiro Oshikiri, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 552 days.

(21) Appl. No.: 13/318,951

(22) PCT Filed: May 21, 2010

(86) PCT No.: PCT/JP2010/003442

§ 371 (c)(1),
(2), (4) Date: Nov. 4, 2011

(87) PCT Pub. No.: WO2010/134355

PCT Pub. Date: Nov. 25, 2010

(65) Prior Publication Data

US 2012/0053950 A1 Mar. 1, 2012

(30) Foreign Application Priority Data

May 22, 2009 (JP) ..... 2009-124592

(51) Int. Cl.

*G10L 19/00* (2013.01)
*G10L 19/005* (2013.01)
*G10L 19/02* (2013.01)
*G10L 19/24* (2013.01)

(52) U.S. Cl.

CPC ..... *G10L 19/005* (2013.01); *G10L 19/0208* (2013.01); *G10L 19/0204* (2013.01); *G10L 19/24* (2013.01)

USPC ..... 704/200.1; 704/229; 704/219; 704/500; 704/230; 375/245; 375/249; 375/252; 341/143; 341/51; 381/17; 381/66; 379/406.06

(58) Field of Classification Search

CPC . G10L 19/0208; G10L 19/24; G10L 19/0212; G10L 19/26; G10L 19/005; G10L 19/008; G10L 19/025; G10L 19/02; G10L 19/038; G10L 19/10; G10L 19/083; G10L 25/18; H04S 1/00; H04H 20/88; H04B 1/712; H04B 7/0854; H04B 7/0848; H04B 2201/70701; H04B 7/0897

USPC ..... 704/200.1, 229, 219, 500–504, 225, 704/230; 375/245, 249, 252, 233, 243; 341/143, 51; 381/17, 66; 379/406.06

See application file for complete search history.

(56) References Cited

U.S. PATENT DOCUMENTS

| | | | | |
|---|---|---|---|---|
| 5,555,310 | A * | 9/1996 | Minami et al. | 381/17 |
| 5,873,058 | A * | 2/1999 | Yajima et al. | 704/201 |
| 6,360,200 | B1 * | 3/2002 | Edler et al. | 704/219 |
| 6,731,691 | B2 * | 5/2004 | Agazzi et al. | 375/285 |
| 6,990,137 | B2 * | 1/2006 | Smee et al. | 375/142 |
| 7,835,910 | B1 * | 11/2010 | Hakkani-Tur et al. | 704/243 |
| 7,835,916 | B2 | 11/2010 | Bruhn | |
| 2002/0169859 | A1 * | 11/2002 | Serizawa | 709/220 |
| 2005/0182996 | A1 * | 8/2005 | Bruhn | 714/752 |
| 2006/0120439 | A1 * | 6/2006 | Smee et al. | 375/148 |
| 2007/0086513 | A1 * | 4/2007 | Fernandez-Corbaton et al. | 375/148 |

FOREIGN PATENT DOCUMENTS

| | | |
|---|---|---|
| JP | 6-236200 | 8/1994 |
| JP | 7-240722 | 9/1995 |
| JP | 11-509388 | 8/1999 |
| JP | 2002-268697 | 9/2002 |
| JP | 2007-529020 | 10/2007 |

OTHER PUBLICATIONS

S. Minami, O. Okuda, "Stereophonic ADPCM Voice Coding Method", IEEE International Conference on Acoustics, Speech and Signal Processing, Apr. 1990, pp. 1113-1116.

M. Goto et al., "A Study of Stereo Speech Coding for Speech Communication Employing the Inter-Channel Information", Institute of Electronics, Information, and Communications Engineers (IEICE) General Conference, 2005, p. 119, (with partial English language translation).

International Search Report, mailed Aug. 10, 2010, for corresponding International Application No. PCT/JP2010/003442.
M. Goto et al., "A Study of Stereo Speech Coding for Speech Communications", Institute of Electronics, Information, and Communications Engineers (IEICE) Engineering Sciences Society Conference, 2004, p. 119, (with partial English language translation).

* cited by examiner

*Primary Examiner* — Vijay B Chawan
(74) *Attorney, Agent, or Firm* — Greenblum & Bernstein, P.L.C.

(57) ABSTRACT

An encoding device, a decoding device, and related methods are provided that eliminate the loss of synchronization of the adaptive filters of a terminal at the encoding end and a terminal at the decoding end caused by transmission errors. Deterioration of the sound quality is suppressed when a multiple channel signal is encoded with high efficiency using an adaptive filter. In the terminal at the encoding end, a buffer stores updated filter coefficients. When packet loss detection information indicating whether there is any packet loss in the terminal at the decoding end indicates that there is packet loss, a switch outputs the past filter coefficients of the previous ($N_X$+1) frames from the buffer to an adaptive filter. The adaptive filter uses the past filter coefficients of the previous ($N_X$+1) frames to conduct filtering.

20 Claims, 11 Drawing Sheets

ENCODING DEVICE, DECODING DEVICE, AND METHODS THEREIN

TECHNICAL FIELD

The present invention relates to an encoding apparatus, a decoding apparatus, and a method thereof for achieving highly efficient encoding of a multi-channel signal using an adaptive filter.

BACKGROUND ART

In a mobile communication system, speech signals are required to be compressed into low bit rates for transmission so as to efficiently utilize radio wave resources and the like. On the other hand, improvement of speech call audio quality and achievement of high quality realistic speech call service are desired. To achieve them, not only a mono signal but also multi-channel audio signals, in particular stereo audio signals, are desirably encoded with high quality.

A method using correlation between channels is effective to encode stereo audio signal (two-channel audio signals) or multi-channel audio signals with low bit rates. A method for backward adaptive prediction of a signal in a channel from a signal in another channel using an adaptive filter is known as a method using correlation between channels (see non-Patent Literature 1 and Patent Literature 1).

In this method, when a signal reaches a left microphone and a right microphone from a sound source, acoustic characteristics between a sound source—a left microphone and between the sound source—a right microphone are estimated using an adaptive filter. A FIR (Finite Impulse Response) filter is used as the adaptive filter.

An estimation method using the adaptive filter will be hereinafter explained using an example where acoustic characteristic of a stereo audio signal are estimated.

In FIG. 1, $H_L(z)$ represents acoustic characteristic between a sound source and a left microphone, and $H_R(z)$ represents acoustic characteristic between the sound source and a right microphone. If the right signal is estimated from the left signal using the adaptive filter, a transfer function G(z) of the adaptive filter is configured to satisfy the relationship of equation 1 with regard to $H_L(z)$ and $H_R(z)$.

(Equation 1)

$$G(z) = \frac{H_R(z)}{H_L(z)} \quad [1]$$

Using the adaptive filter having the transfer function G(z) satisfying equation 1, the right signal is estimated from the left signal, and the estimated error is quantized. In this manner, using the adaptive filter, the correlation between the left signal and the right signal is removed, whereby efficient encoding can be achieved.

The transfer function G(z) of the adaptive filter is expressed as equation 2.

(Equation 2)

$$G(z) = \sum_{n=0}^{N-1} g_k(n) \cdot z^{-n} \quad [2]$$

In equation 2, $g_k(n)$ denotes the n-th (filter coefficient order n) filter coefficient of the adaptive filter at time k, z denotes a z-transformation variable, and N denotes a filter order of the adaptive filter (the maximum value of filter coefficient order n).

The adaptive filter estimates acoustic characteristic while successively updating the filter coefficient in units of sample processings. When learning identification method (NLMS (normalized least-mean-square)) algorithm is used to update the filter coefficient of the adaptive filter, filter coefficient $g_k(n)$ of the adaptive filter is updated according to equation 3.

(Equation 3)

$$g_{k+1}(n) = g_k(n) + \frac{\alpha}{\sum_{i=0}^{N-1} x_k(i)^2 + \beta} \cdot e(k) \cdot x_k(n) \quad [3]$$

(for all $n$)

As described above, $g_k(n)$ denotes the n-th (filter coefficient order n) filter coefficient of the adaptive filter at time k, and N denotes the filter order of the adaptive filter (the maximum value of filter coefficient order n). On the other hand, e(k) denotes an error signal at time k, and $x_k(n)$ denotes an input signal at time k multiplied by the n-th (filter coefficient order n) filter coefficient of the adaptive filter. $\alpha$ denotes a parameter for controlling update speed of the adaptive filter, and $\beta$ denotes a parameter for preventing a denominator of equation 3 from being zero. $\beta$ is a positive value.

At this occasion, the filter order N of the adaptive filter needs to be determined according to acoustic characteristic between the sound source and the microphone. For example, it is necessary to represent acoustic characteristic for a time length of about 100 ms in order to ensure sufficient performance. In this case, the filter coefficient of the adaptive filter needs to have a filter order N for the time length of 100 ms. Accordingly, when the sampling frequency of the input signal is 32 kHz, the filter order N of the adaptive filter required to obtain the acoustic characteristic for the time length of 100 ms is 3200.

As described above, the filter coefficients of the adaptive filter are updated using input signal $x_k(n)$ input to the adaptive filter and error signal e(k). In this case, more specifically, input signal $x_k(n)$ is a signal obtained by encoding/decoding one of channel signals. On the other hand, the error signal is a signal obtained by subtracting a signal predicted using the adaptive filter from the other of the channel signals and encoding/decoding the signal obtained by the subtraction. Therefore, both of the error signal and the input signal can be generated without using any additional information in each of the encoding section and the decoding section. In other words, the adaptive filters of the encoding section and the decoding section can be updated completely the same without increasing the bit rate. This is one of advantages of the encoding method using the adaptive filter.

CITATION LIST

Patent Literature

PTL 1

Published Japanese Translation No. H11-509388 of the PCT International Publication Non-Patent Literature

NPL 1

S. Minami, O. Okuda, "Stereophonic ADPCM Voice Coding Method", IEEE International Conference on Acoustics, Speech, and Signal Processing 1990 (ICASSP 1990), April, 1990, pp. 1113-1116

SUMMARY OF INVENTION

Technical Problem

On the other hand, however, there are the following problems when transmission error such as packet loss or bit error occurs. In other words, when the transmission error occurs, the input signal and the error signal used for updating filter coefficients are different in each of the encoding section and the decoding section. As a result, the filter coefficients are updated using the different signals, and therefore, the filter coefficients are different in the encoding section and the decoding section. Different filter coefficients in the encoding section and the decoding section will be hereinafter expressed as "desynchronization of the adaptive filters". In contrast, the same filter coefficients in the adaptive filters of the encoding section and the decoding section will be expressed as "synchronization of the adaptive filters".

Once transmission error occurs and causes desynchronization of the adaptive filters of the encoding section and the decoding section, the synchronization cannot be made immediately, and it takes some time to make synchronization, during which time there is a problem in that the sound quality of the decoded signal is deteriorated.

An object of the present invention is to provide an encoding apparatus, a decoding apparatus, and a method thereof capable of suppressing deterioration of sound quality by quickly solving desynchronization of adaptive filters at an encoding-side terminal and a decoding-side terminal caused by transmission error such as packet loss when a multi-channel signal is encoded with high efficiency using the adaptive filters.

Solution to Problem

An encoding apparatus according to the present invention employs a configuration including a first encoding section that generates first encoded information by encoding a first channel signal, a first decoding section that generates a first decoded signal by decoding the first encoded information, an adaptive filter that performs filter processing on the first decoded signal and generates a predicted signal of the second channel signal, an error signal generating section that generates an error signal by obtaining an error between the second channel signal and the predicted signal, a second encoding section that generates second encoded information by encoding the error signal, a second decoding section that generates a decoded error signal by decoding the second encoded information, and a storing section that stores filter coefficients used in the filter processing, the encoding apparatus further including a first switching section that switches a connection state from the storing section to the adaptive filter, based on first detection information indicating presence/absence of transmission error, wherein the adaptive filter uses the first decoded signal and the decoded error signal to update the filter coefficients, and when the first switching section connects the storing section and the adaptive filter, the adaptive filter receives the filter coefficients of the past from the storing section to use the filter coefficients of the past as the filter coefficients of the adaptive filter and performs the filter processing.

A decoding apparatus according to the present invention employs a configuration including a first decoding section that generates a first decoded signal by decoding first encoded information relating to a first channel signal, a second decoding section that generates a decoded error signal by decoding second encoded information relating to a second channel signal, an adaptive filter that generates the predicted signal by performing filter processing on the first decoded signal and uses the first decoded signal and the decoded error signal to update filter coefficients used in the filter processing, and a storing section that stores the filter coefficients, the decoding apparatus further including a detection section that detects presence/absence of transmission error and generates a detection result as first detection information, a measuring section that counts an elapsed time since the detection result indicated that presence of transmission error was detected, and a first switching section that connects the storing section and the adaptive filter when the elapsed time matches a predetermined time, wherein, when the first switching section connects the storing section and the adaptive filter, the adaptive filter receives filter coefficients of the past from the storing section and performs the filter processing using the filter coefficients of the past as the filter coefficients of the adaptive filter.

An encoding method according to the present invention includes a first encoding step of generating first encoded information by encoding a first channel signal, a first decoding step of generating a first decoded signal by decoding the first encoded information, a filtering step of performing filter processing on the first decoded signal with an adaptive filter and generating a predicted signal of the second channel signal, an error signal generating step of generating an error signal by obtaining an error between the second channel signal and the predicted signal, a second encoding step of generating second encoded information by encoding the error signal, a second decoding step of generating a decoded error signal by decoding the second encoded information, an updating step of using the first decoded signal and the decoded error signal to update the filter coefficients of the adaptive filter, and a storing step of storing the updated filter coefficients to a memory, the encoding method further including a first switching step of switching a connection state from the memory to the adaptive filter, based on first detection information indicating presence/absence of transmission error, wherein, when the memory and the adaptive filter are connected in the first switching step, the adaptive filter receives the filter coefficients of the past from the memory to use the filter coefficients of the past as the filter coefficients of the adaptive filter and performs the filter processing in the filtering step.

A decoding method according to the present invention includes a first decoding step of generating a first decoded signal by decoding first encoded information relating to a first channel signal; a second decoding step of generating a decoded error signal by decoding second encoded information relating to a second channel signal; a filtering step of generating the predicted signal by performing filter processing on the first decoded signal with an adaptive filter and using the first decoded signal and the decoded error signal to update filter coefficients used in the filter processing; and a storing step of storing the updated filter coefficients to a memory, the decoding method further including a detection step of detecting presence/absence of transmission error and generating a detection result as first detection information; a measuring step of counting an elapsed time since the detection result indicated that presence of transmission error was detected; and a first switching step of connecting the memory and the adaptive filter when the elapsed time matches a predetermined time, wherein, when the memory and the adaptive filter are connected in the first switching step, the adaptive filter receives the filter coefficients of the past from the memory to use the filter coefficients of the past as the filter coefficients of the adaptive filter and performs the filter processing in the filtering step.

Advantageous Effects of Invention

According to the present invention, when a multi-channel signal is encoded with high efficiency using the adaptive filters, deterioration of sound quality can be suppressed by quickly solving desynchronization of adaptive filters at an encoding-side terminal and a decoding-side terminal caused by transmission error such as packet loss.

DESCRIPTION OF EMBODIMENTS

Embodiments of the present invention will be hereinafter described with reference to drawings.

According to the present invention, when a multi-channel signal is encoded with high efficiency using the adaptive filters, synchronization of adaptive filters can be quickly made at an encoding-side terminal and a decoding-side terminal even if transmission error occurs. In the explanation below, for example, a stereo audio signal is encoded/decoded. In the explanation, a channel used for prediction is a left signal (L signal), and a predicted channel is a right signal (R signal). In the explanation below, occurrence of packet loss is explained as an example of transmission error. Embodiments will be hereinafter explained.

Embodiment 1

Figure 1:
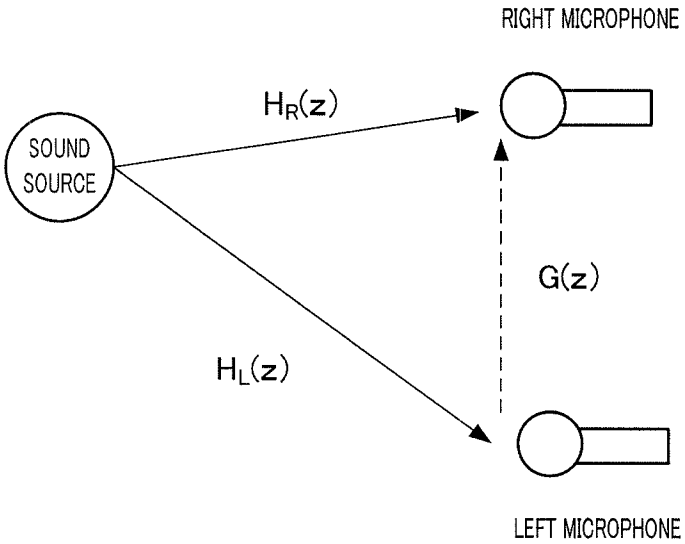
FIG. 1 is a figure for explaining a method for estimating acoustic characteristic of a stereo audio signal.
Figure 2:
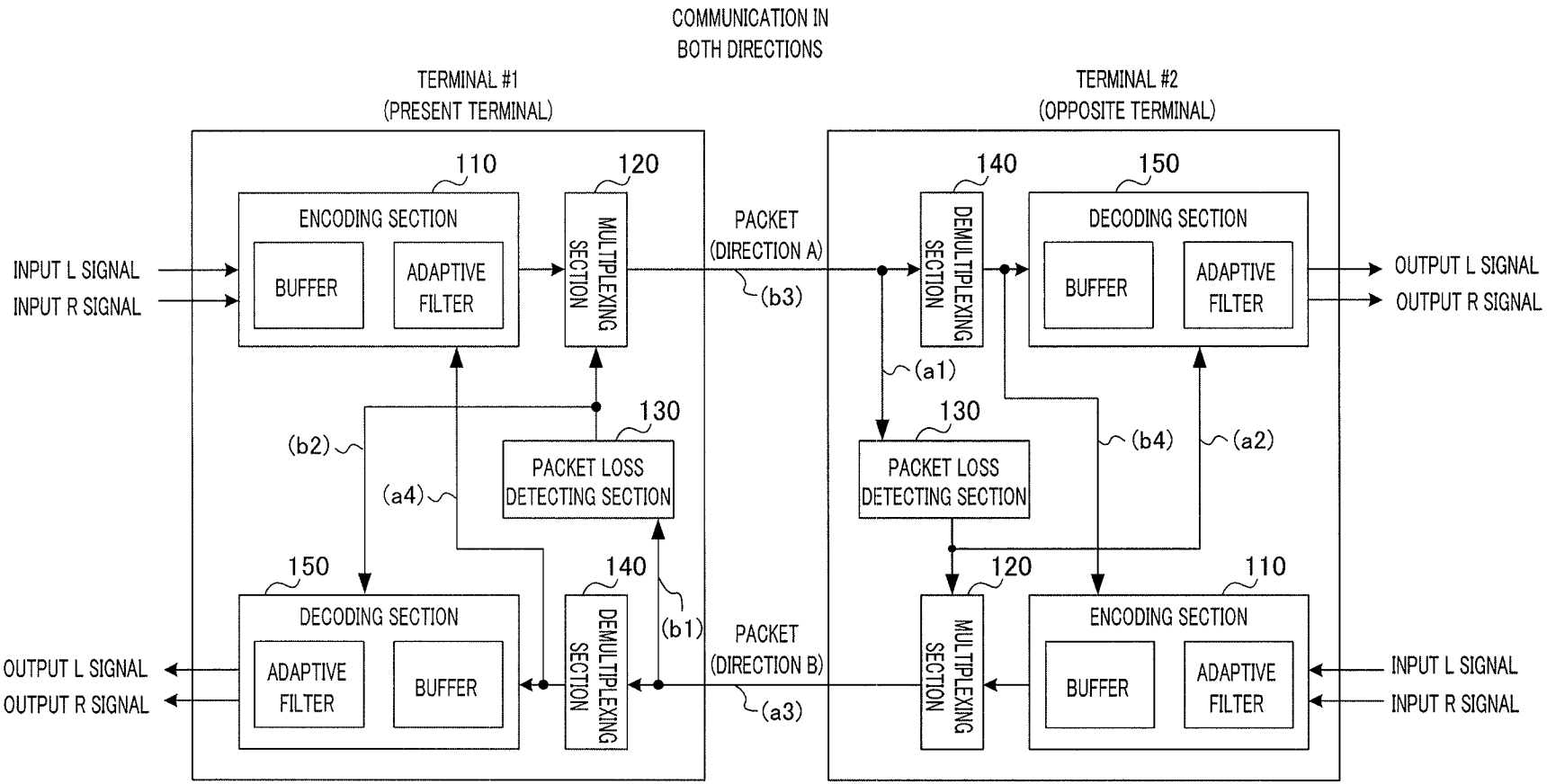
FIG. 2 is a schematic diagram illustrating a principle-part configuration of a terminal according to Embodiment 1 of the present invention.

FIG. 2 is a schematic diagram illustrating a principle-part configuration of a communication terminal apparatus (hereinafter abbreviated as "terminal") having an encoding section and a decoding section according to present embodiment.

As shown in FIG. 2, terminal #1 and terminal #2 communicate with each other in both directions. In the example as shown in FIG. 2, terminal #1 and terminal #2 receive a two-channel signal, and encode the two-channel signal and decode the two-channel signal, respectively.

In FIG. 2, signal lines (a1) to (a4) denote signal lines from terminal #2 to terminal #1 for notification of packet loss detection information explained later. Signal lines (b1) to (b4) denote signal lines from terminal #1 to terminal #2 for notification of packet loss detection information. Signal lines (a1) to (a4) are signal lines where terminal #1 is used as an encoding-side terminal (hereinafter abbreviated as "the present terminal") and terminal #2 is used as a decoding-side terminal (hereinafter abbreviated as "opposite terminal"). Signal lines (b1) to (b4) are signal lines where terminal #2 is used as an encoding-side terminal (the present terminal) and terminal #1 is used as a decoding-side terminal (opposite terminal). Both of signal lines (a1) to (a4) and signal lines (b1) to (b4) denote signal lines from the opposite terminal to the present terminal up to notification of the packet loss detection information. In the explanation below, signal lines (a1) to (a4) will be explained. Explanation about signal lines (b1) to (b4) is omitted. For this reason, in the explanation below, terminal #1 is referred to as the present terminal, terminal #2 is referred to as the opposite terminal.

It should be noted that FIG. 2 is an example of configuration where notification of the packet loss detection information is transmitted in-band from the opposite terminal to the present terminal. In in-band transmission, the opposite terminal transmits multiplexed data including notification of the packet loss detection information to the present terminal.

(Signal Line (a1): Encoding Side of the Present Terminal)

Encoding section 110 of the present terminal receives a stereo audio signal including a left channel signal and a right channel signal for each frame of about 20 ms. Encoding section 110 performs encoding processing on the received left channel signal (hereinafter abbreviated as "input L signal") and the received right channel signal (hereinafter abbreviated as "input R signal"), thereby generating encoded data. It should be noted that the details of internal configuration of encoding section 110 will be explained later.

Multiplexing section 120 generates a packet from the obtained encoded data, and the generated packet is transmitted via transmission path to the opposite terminal.

(Signal Line (a2): Decoding Side of the Opposite Terminal)

Packet loss detecting section 130 and demultiplexing section 140 of the opposite terminal receive the packet that is output from encoding section 110 of the present terminal.

Packet loss detecting section 130 determines whether a packet is received from the present terminal or not. When a packet transmitted from the present terminal is received, the packet loss detection information is set to zero. On the other hand, when no packet is received from the present terminal, it is deemed that packet loss occurs, and accordingly, the packet loss detection information is set to one. The packet loss detection information is output to decoding section 150 and multiplexing section 120.

Demultiplexing section 140 of the opposite terminal separates the packet transmitted from the opposite terminal into encoded data and packet loss detection information (about packet loss of packets transmitted from the terminal #1). The encoded data are output to decoding section 150, and the packet loss detection information (about packet loss of packets transmitted from terminal #1) is output to encoding section 110.

Decoding section 150 of the opposite terminal uses the encoded data and the packet loss detection information that is output from packet loss detecting section 130 to generate an output L signal and an output R signal. The details of decoding section 150 will be explained later.

(Signal Line (a3): Encoding Side of the Opposite Terminal)

Multiplexing section 120 of the opposite terminal embeds, into a packet, the packet loss detection information that is output from packet loss detecting section 130, and the packet is transmitted via the transmission path to the present terminal. The packet also includes the encoded data to be transmitted from the opposite terminal to the present terminal.

(Signal Line (a4): the Decoding Side of the Present Terminal)

Demultiplexing section 140 of the present terminal separates the packet transmitted from the opposite terminal into encoded data and packet loss detection information (about packet loss of packets transmitted from terminal #2). The encoded data are output to decoding section 150, and the packet loss detection information (about packet loss of packets transmitted from terminal #2) is output to encoding section 110.

As described above, notification of the packet loss detection information is transmitted from the opposite terminal to the present terminal, and the packet loss detection information is output to encoding section 110 of the present terminal. On the other hand, in the opposite terminal, the packet loss detection information is output to decoding section 150 of the opposite terminal. When the packet loss detection information of the opposite terminal indicates one, filter coefficients in the adaptive filters of encoding section 110 of the present terminal and decoding section 150 of the opposite terminal are replaced with filter coefficients given by a buffer. However, decoding section 150 of the opposite terminal waits until the packet loss detection information of the opposite terminal reaches encoding section 110 of the present terminal, and then replaces the filter coefficients of the adaptive filter. In other words, encoding section 110 of the present terminal and decoding section 150 of the opposite terminal replaces the filter coefficients of the adaptive filters with filter coefficients of the past at the same time. This waiting time is equal to a time required to transmit notification of the packet loss detection information of the opposite terminal from the opposite terminal to the present terminal (notification time), and this waiting time is unique to a system. Therefore, the waiting time is defined in advance as the number of frames for which it is necessary to keep waiting.

As described above, encoding section 110 of the present terminal and decoding section 150 of the opposite terminal replace the filter coefficients of the adaptive filters with the filter coefficients of the frames of the past when packet loss occurs in the opposite terminal. At this occasion, decoding section 150 of the opposite terminal waits until the packet loss detection information of the opposite terminal reaches encoding section 110 of the present terminal, and then replaces the filter coefficients of the adaptive filter. Therefore, even when packet loss occurs, the encoding side and the decoding side can replace the filter coefficients of the adaptive filters with the filter coefficients of the frames of the past at the same time. Therefore, when desynchronization occurs in the adaptive filters, prolonged desynchronization of the adaptive filter can be prevented, and the degree of reliability of the filter coefficients can be recovered in a short time.

The overview of the method for replacing the filter coefficients of the adaptive filters according to present embodiment has been hereinabove explained. The details of operations and internal configurations of the present terminal and the opposite terminal will be hereinafter explained.

Figure 3:
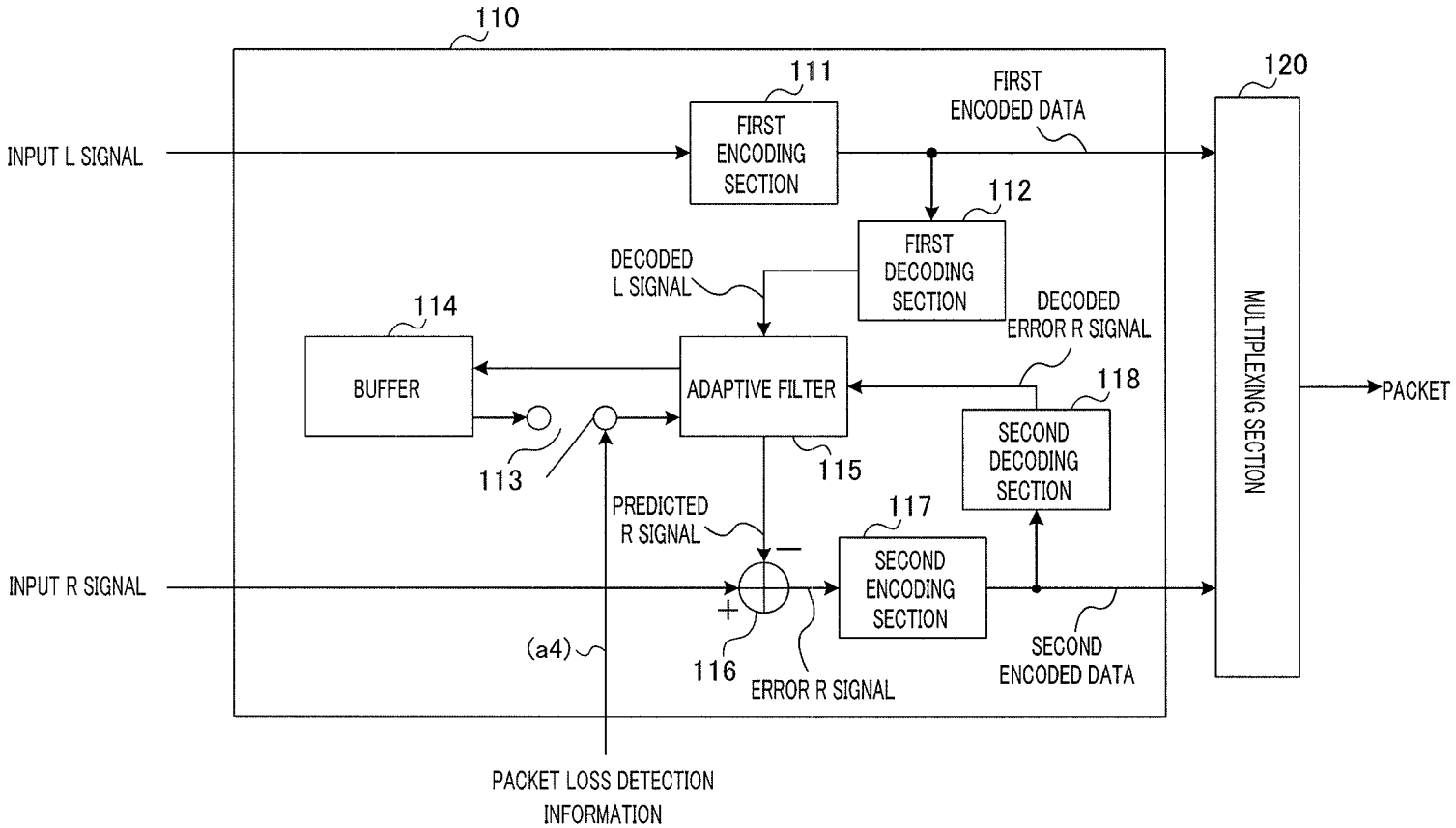
FIG. 3 is a block diagram illustrating a principle-part configuration of an encoding-side terminal according to Embodiment 1 (the present terminal)

FIG. 3 is a block diagram illustrating a principle-part configuration of the encoding-side terminal (the present terminal) according to present embodiment. It should be noted that FIG. 3 shows constituent parts concerning encoding, but does not show nor explain constituent parts concerning decoding for the sake of simplifying the explanation.

First encoding section 111 performs encoding processing on the received left channel signal (input L signal), generates first encoded data through the encoding processing, and outputs the first encoded data to multiplexing section 120. First encoding section 111 also outputs the first encoded data to first decoding section 112.

First decoding section 112 performs decoding processing on the first encoded data, and generates a decoded L signal. First decoding section 112 outputs the generated decoded L signal to adaptive filter 115.

Switch 113 looks up the packet loss detection information transmitted from the opposite terminal, and when the packet loss detection information is one, i.e., when the opposite terminal detects packet loss, switch 113 is turned on. On the other hand, when the packet loss detection information is zero, i.e., when the opposite terminal does not detect any packet loss, switch 113 is turned off.

Buffer 114 stores at least filter coefficients for the past ($N_X$+1)-th frames. In this case, $N_X$ denotes the number of frames corresponding to a time taken to transmit the packet loss detection information from the opposite terminal to the present terminal (notification time).

When switch 113 is turned on, buffer 114 outputs, to the adaptive filter 115, stored filter coefficients of adaptive filter 115 for the frame located ($N_X$+1) frames before the current frame.

Adaptive filter 115 has a transfer function expressed as equation 2, performs filter processing in units of sample processings on the decoded L signal, and generates a predicted R signal. The predicted R signal is generated using equation 4.

(Equation 4)

$$R'(i) = \sum_{n=0}^{N-1} g_k(n) \cdot L_{dec}(i-n) \quad [4]$$

In this case, $L_{dec}$(i) denotes the decoded L signal at time i, and $g_k$(n) denotes the n-th (filter coefficient order n) filter coefficient of adaptive filter 115 at time k, and R'(k) denotes the predicted R signal at time i.

As can be seen from equation 4, the predicted R signal is obtained by convolution operation of the filter coefficients of adaptive filter 115 and the decoded L signal. Adaptive filter 115 outputs the generated predicted R signal to subtraction section 116.

When switch 113 is turned on, adaptive filter 115 replaces the filter coefficients of adaptive filter 115 with the filter coefficients sent from buffer 114, and performs filtering operation. On the other hand, when switch 113 is turned off, adaptive filter 115 performs filtering operation using the current filter coefficients of the adaptive filter.

Subtraction section 116 subtracts the predicted R signal from the received right channel signal (input R signal), and generates an error R signal. Subtraction section 116 outputs the generated error R signal to second encoding section 117.

Second encoding section 117 performs encoding processing on the error R signal, and generates second encoded data. Second encoding section 117 outputs the second encoded data to multiplexing section 120. Second encoding section 117 also outputs the second encoded data to second decoding section 118.

Second decoding section 118 performs decoding processing on the second encoded data, and generates the decoded error R signal. Second decoding section 118 outputs the generated decoded error R signal to adaptive filter 115.

Adaptive filter 115 uses the decoded error R signal and the decoded L signal to update the filter coefficient of adaptive filter 115 according to equation 5, thus preparing for processing of subsequent input signal.

(Equation 5)

$$g_{k+1}(n) = g_k(n) + \frac{\alpha}{\sum_{i=0}^{N-1} L_{dec}(i)^2 + \beta} \cdot R_{e_dec}(k) \cdot L_{dec}(n) \quad [5]$$

In equation 5, $L_{dec}(n)$ denotes the decoded L signal multiplied with the n-th (filter coefficient order n) filter coefficient $g_k(n)$ of adaptive filter 115, and $R_{e_dec}(k)$ denotes the decoded error R signal at time k.

Adaptive filter 115 outputs the updated filter coefficients to buffer 114.

Buffer 114 discards the oldest filter coefficients of the filter coefficients stored in buffer 114, and stores the filter coefficients of the current frame newly updated by adaptive filter 115. For example, when buffer 114 stores the filter coefficients for the past $(N_X+1)$-th frames, buffer 114 discards the filter coefficients located $(N_X+1)$ frames before the current frame, and stores the updated filter coefficients of the current frame.

Multiplexing section 120 multiplexes the first encoded data and the second encoded data, generates a packet from the obtained multiplexed data, and outputs the generated packet to a transmission path, not shown.

Figure 4:
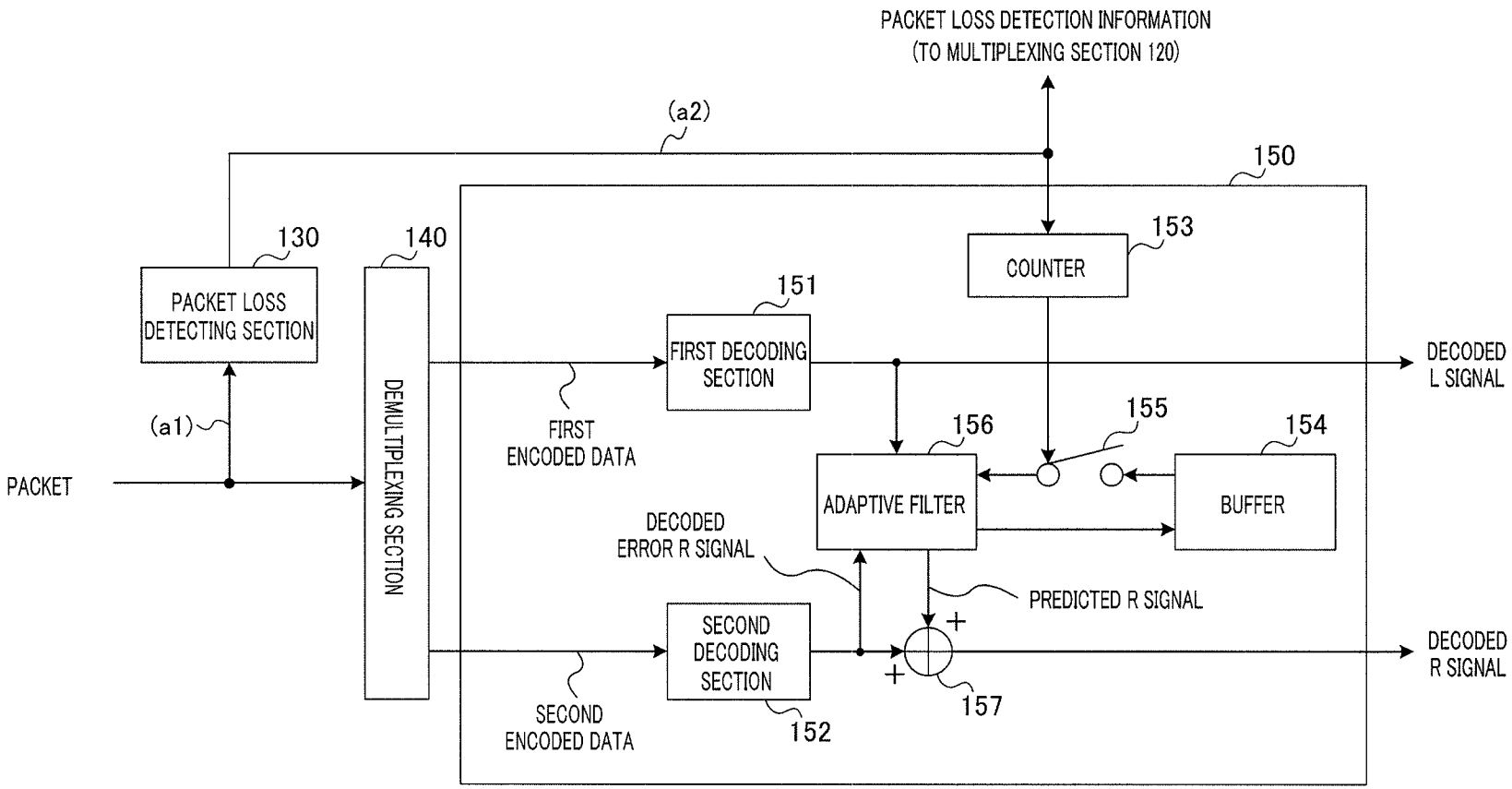
FIG. 4 is a block diagram illustrating a principle-part configuration of a decoding-side terminal according to Embodiment 1 (opposite terminal)

FIG. 4 is a block diagram illustrating a principle-part configuration of a decoding-side terminal according to present embodiment (opposite terminal). It should be noted that FIG. 4 shows constituent parts concerning decoding, but does not show nor explain constituent parts concerning encoding for the sake of simplifying the explanation. The opposite terminal of FIG. 4 receives the packet transmitted from the present terminal of FIG. 3.

Packet loss detecting section 130 detects presence/absence of packet loss as transmission error. For example, packet loss detecting section 130 detects presence/absence of packet loss by determining whether a packet is received from the present terminal or not. When the packet is received, packet loss detecting section 130 sets the packet loss detection information to zero. On the other hand, when no packet is received, packet loss detecting section 130 deems that packet loss occurs, and sets the packet loss detection information to one. Packet loss detecting section 130 outputs the packet loss detection information to counter 153 and multiplexing section 120.

Demultiplexing section 140 demultiplexes the multiplexed data included in the packet into the first encoded data and the second encoded data, outputs the first encoded data to first decoding section 151, and outputs the second encoded data to second decoding section 152.

First decoding section 151 performs decoding processing on the first encoded data, and generates the decoded L signal. First decoding section 151 outputs the decoded L signal to adaptive filter 156.

Second decoding section 152 performs decoding processing on the second encoded data, and generates the decoded error R signal. Second decoding section 152 outputs the decoded error R signal to addition section 157 and adaptive filter 156.

When counter 153 receives the packet loss detection information, and the packet loss detection information indicates one, i.e., the packet loss detection information indicates presence of packet loss, counter 153 starts counting. Counter 153 counts the number of processed frames after the counting starts. For example, counter 153 increases the counter by one when the processing for one frame is finished. Then, counter 153 turns on switch 155 when the counter becomes $N_X$. At this occasion, $N_X$ is the number of frames corresponding to a time taken for the packet loss detection information to reach the present terminal from the opposite terminal (notification time). In other words, counter 153 turns on switch 155 after $N_X$ frames since the packet loss detection information indicates one.

Buffer 154 stores at least filter coefficients for the past $(N_X+1)$-th frames of adaptive filter 156.

When switch 155 is turned on, buffer 154 outputs, to the adaptive filter 156, stored filter coefficients of adaptive filter 156 for the frame located $(N_X+1)$ frames before the current frame.

Switch 155 is turned on or off according to an instruction given by counter 153. More specifically, switch 155 is turned on after $N_X$ frames have passed since packet loss is detected. As a result, filter coefficients of adaptive filter 156 stored in buffer 154 for the frame located $(N_X+1)$ frames before the current frame are output to adaptive filter 156. On the other hand, when the packet loss detection information is zero, i.e., when the opposite terminal does not detect any packet loss, switch 155 is turned off.

Like adaptive filter 115 of encoding section 110, adaptive filter 156 performs filter processing on the decoded L signal, generates a predicted R signal, and outputs the generated predicted R signal to addition section 157. A generation method for generating the predicted R signal in adaptive filter 156 is the same as the generation method in adaptive filter 115 of encoding section 110, and therefore description thereabout is omitted here.

It should be noted that when switch 155 is turned on, adaptive filter 156 replaces the filter coefficients of adaptive filter 116 with the filter coefficients sent from buffer 154, and performs filtering operation. On the other hand, when switch 155 is turned off, adaptive filter 116 performs filtering operation using the current filter coefficients of the adaptive filter.

Addition section 257 adds the predicted R signal and the decoded error R signal, generates the decoded R signal, and outputs the generated decoded R signal.

Like adaptive filter 115 of encoding section 110, adaptive filter 156 updates the filter coefficients of adaptive filter 156 based on the decoded L signal and the decoded error R signal, and outputs the updated filter coefficients to buffer 154. An update method for updating the filter coefficients is the same as the update method in adaptive filter 115 of encoding section 110, and therefore description thereabout is omitted here.

Then, buffer 154 discards the oldest filter coefficient of the filter coefficients stored in buffer 154, and stores the filter coefficient of the current frame newly updated by adaptive filter 156. For example, when buffer 154 stores the filter coefficients for the past ($N_X$+1)-th frames of adaptive filter 156, buffer 154 discards the filter coefficient located ($N_X$+1) frames before the current frame, and stores the updated filter coefficient of the current frame.

Figure 5:
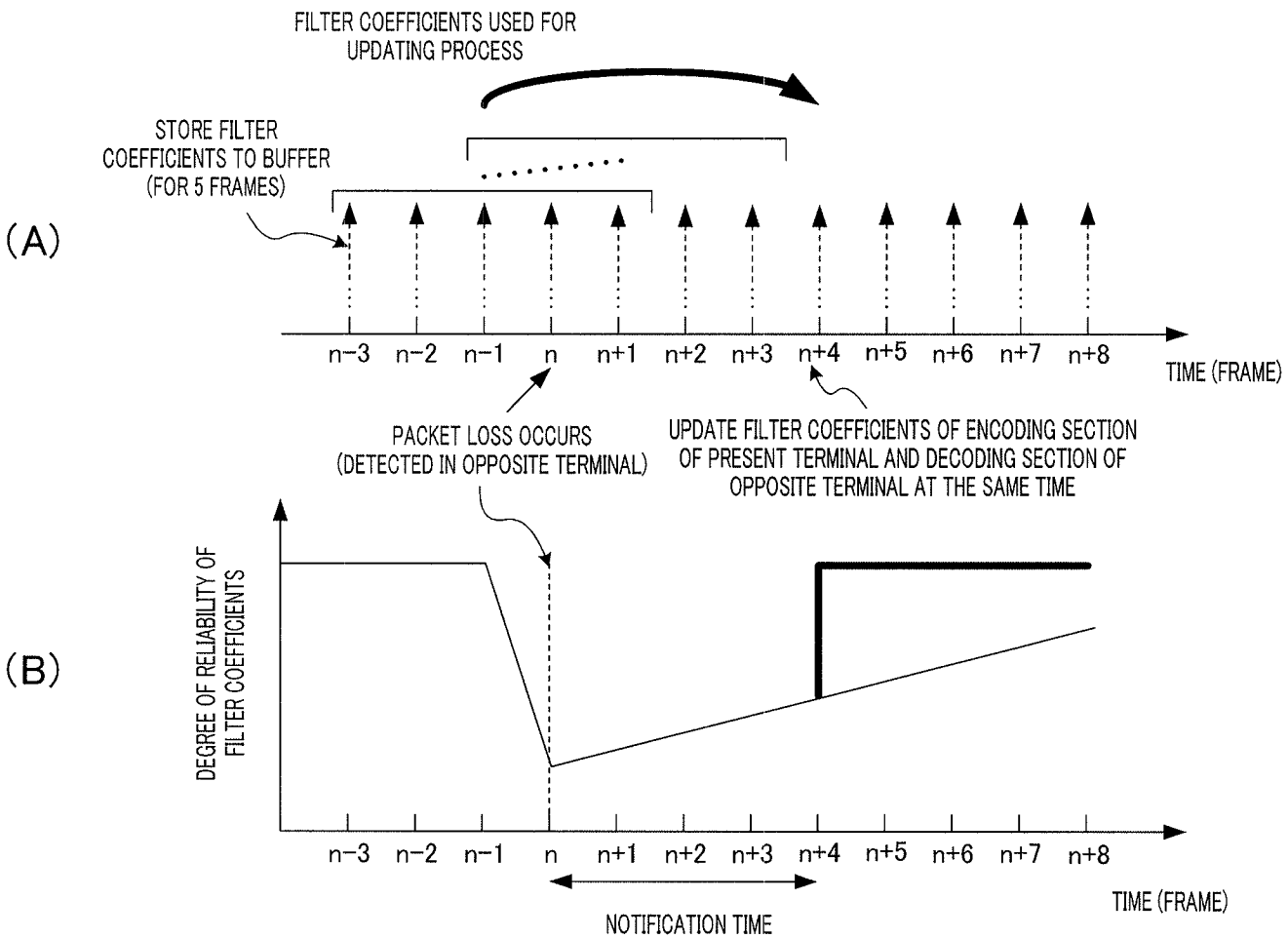
FIG. 5 is a figure for explaining a method for replacing filter coefficients of an adaptive filter according to Embodiment 1.

Subsequently, the method for replacing the filter coefficients of adaptive filter 115 and adaptive filter 156 according to present embodiment will be explained with reference to FIG. 5.

As described above, in present embodiment, the present terminal and the opposite terminal holds at least the filter coefficients for one plus the number of frames $N_X$ corresponding to the time required to transmit notification of occurrence of the packet loss in the opposite terminal from the opposite terminal to the present terminal (notification time). Since the time required to transmit the notification from the opposite terminal to the present terminal is unique to the system, the number of frames ($N_X$+1) for which the filter coefficients are held can be known in advance.

In the explanation below, for example, the notification time taken to transmit occurrence of packet loss is assumed to be 4 frames ($N_X$=4). In this case, the present terminal and the opposite terminal hold at least the filter coefficients for 5 (=4+1)-th frames. At this occasion, the following case will be considered. As shown in FIG. 5(A), packet loss occurs in the n-th frame in a direction in which the multiplexed data are transmitted from the present terminal to the opposite terminal (direction A of FIG. 2).

When packet loss detecting section 130 of the opposite terminal detects loss of the packet sent from the present terminal, the packet loss detection information is set to one. The notification of the packet loss detection information is transmitted from the opposite terminal to the present terminal.

When the opposite terminal transmits, to the present terminal, the notification of the packet loss detection information indicating that packet loss occurs in the opposite terminal, switch 113 of the present terminal is turned on, the filter coefficients stored in buffer 114 for the frame located ($N_X$+1) frames before the current frame are output to adaptive filter 115. As a result, the filter coefficients of adaptive filter 115 are replaced with the filter coefficients for the frame located ($N_X$+1) frames before the current frame.

When packet loss occurs, the opposite terminal causes counter 153 to count the number of subsequent frame processings, and as soon as the count value becomes $N_X$, switch 155 is turned on. As a result, buffer 154 outputs the filter coefficients for the frame located ($N_X$+1) frames before the current frame to adaptive filter 156, and the filter coefficients of adaptive filter 156 are replaced with the filter coefficients for the frame located ($N_X$+1) frames before the current frame.

By doing so, the filter coefficients of adaptive filter 115 and adaptive filter 156 in the present terminal and the opposite terminal are replaced with the filter coefficients for the frame located ($N_X$+1) frames before the current frame at the same time. Thereafter, both of adaptive filter 115 and adaptive filter 156 perform filter processing using the replaced filter coefficients. When the filter coefficients are thus forcibly replaced with the filter coefficients of the past, filter processing can be performed without using the filter coefficients affected by the packet loss, and this can prevent prolonged effect of the packet loss. As a result, even when transmission error occurs, the degree of reliability of the filter coefficients can be recovered in a short time.

FIG. 5(B) illustrates the degree of reliability of the filter coefficients in each frame when packet loss occurs in the n-th frame. The degree of reliability of the filter coefficients is the degree of matching between the filter coefficients of adaptive filter 115 of encoding section 110 of the present terminal and the filter coefficients of adaptive filter 156 of decoding section 150 of the opposite terminal. In FIG. 5(B), a solid line shows how the degree of reliability changes when the filter coefficients are not replaced. On the other hand, a thick line shows how the degree of reliability changes when the filter coefficients are replaced as explained in present embodiment. More specifically, the thick line shows the degree of the reliability of the filter coefficients in a case where packet loss occurs in the n-th frame, and filter coefficients used in the (n+4)-th frame of adaptive filter 115 and adaptive filter 156 are replaced with filter coefficients located five frames before the current frame (filter coefficients of the (n−1)-th frame).

As can be seen from FIG. 5(B), the degree of the reliability of the filter coefficients greatly decrease in the n-the frame at which packet loss occurs, and gradually improves as subsequent frames are transmitted and received. However, as the solid line indicates, many frames must be passed until the degree of the reliability of the filter coefficients completely recovers back to the original degree of the reliability.

In contrast, when packet loss occurs in the n-th frame, and the filter coefficients used in the (n+4)-th frame of adaptive filter 115 and adaptive filter 156 are replaced with the filter coefficients located five frames before the current frame (the filter coefficients of the (n−1)-th frame), synchronization between adaptive filter 115 and adaptive filter 156 can be made from the (n+5)-th frame, and this can suppress deterioration of sound quality in the (n+5)-th frame and subsequent frames.

As described above, when packet loss occurs, the filter coefficients of adaptive filter 115 and adaptive filter 156 are replaced with the filter coefficients of the past located ($N_X$+1) frames before the current frame, so that the degree of the reliability of the filter coefficients can be improved in a short time.

As described above, in present embodiment, in the present terminal, buffer 114 stores the updated filter coefficients, and demultiplexing section 140 obtains the packet loss detection information indicating presence/absence of packet loss in the opposite terminal. When the packet loss detection information indicates presence of packet loss, switch 113 outputs, to adaptive filter 115, the filter coefficients of the past stored in buffer 114 for the frame located ($N_X$+1) frames before the current frame, and adaptive filter 115 replaces the filter coefficients of adaptive filter 115 with the filter coefficients of the past for the frame located ($N_X$+1) frames before the current frame, and performs filter processing using the replaced filter coefficients.

On the other hand, in the opposite terminal, packet loss detecting section 130 detects presence/absence of packet loss, and generates a detection result as packet loss detection information. Counter 153 counts an elapsed time since the packet loss is detected. When the elapsed time matches the notification time corresponding to the $N_X$ frames, switch 155 outputs, to adaptive filter 116, the filter coefficients of the past stored in buffer 154 for the frame located ($N_X$+1) frames before the current frame, and adaptive filter 156 replaces the filter coefficients of adaptive filter 156 with the filter coefficients of the past for the frame located ($N_X$+1) frames before the current frame, and performs filter processing using the replaced filter coefficients.

As described above, in present embodiment, the present terminal serving as the encoding-side terminal and the opposite terminal serving as the decoding-side terminal store the filter coefficients of adaptive filters 115, 156. When transmission error such as packet loss occurs, the filter coefficients of adaptive filters 115, 156 are replaced with the filter coefficients of the past at the same time based on the notification time between the present terminal and the opposite terminal. As a result, even when transmission error such as packet loss occurs, and synchronization is lost between the adaptive filters of the present terminal and the opposite terminal, desynchronization can be solved in a short time, and therefore, deterioration of sound quality can be suppressed.

Figure 6:
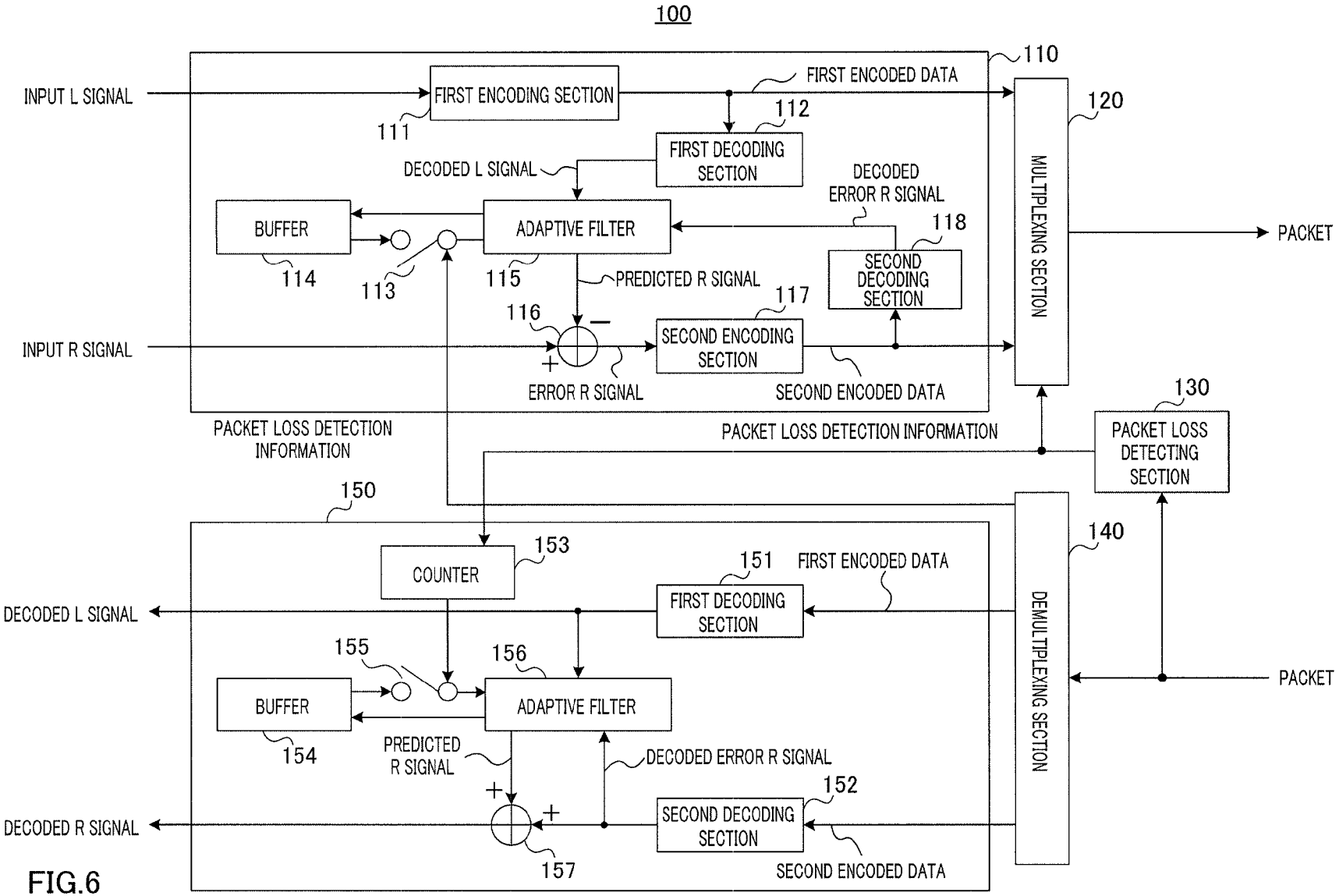
FIG. 6 is a block diagram illustrating a principle-part configuration of the terminal according to Embodiment 1.

FIG. 6 shows a configuration of terminal 100 including constituent parts concerning encoding and decoding process of present embodiment. It should be noted that the same constituent portions of FIG. 6 as those of FIGS. 3 and 4 are denoted with the same reference numerals as those of FIGS. 3 and 4, and description thereabout is omitted.

Embodiment 2

In Embodiment 1, buffer 114 and buffer 154 store at least the filter coefficients for the past ($N_X$+1)-th frames. In this case, $N_X$ denotes the number of frames corresponding to a time taken to transmit the packet loss detection information from the opposite terminal to the present terminal (notification time).

In present embodiment, the buffer stores the filter coefficients only when sense of stereo of multi-channel audio signals (stereo image) changes over time. In short, the sense of stereo means directionality of a sound source, i.e., from which of right and left a person hears a sound source, or balance between right and left sound pressures. Therefore, like Embodiment 1, desynchronization of the adaptive filters of the encoding-side terminal and the decoding-side terminal caused by transmission error can be solved in a short time, and prolonged displacement of the filter coefficients can be prevented. As a result, deterioration of sound quality can be suppressed, and this can achieve reduction of the amount of processing required to store the filter coefficients to the buffer and reduction of the amount of memory capacity of the buffer.

Figure 7:
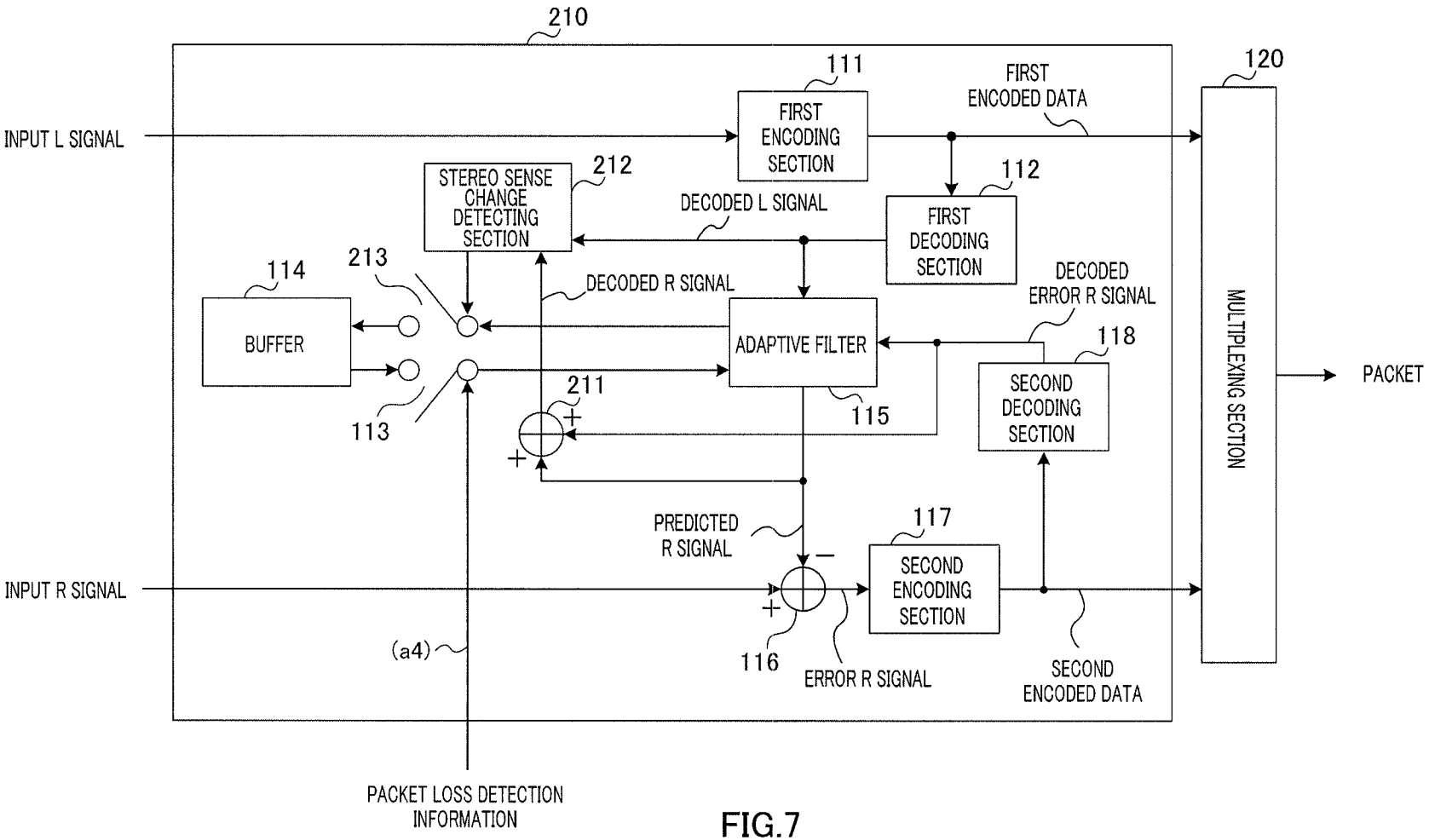
FIG. 7 is a block diagram illustrating a principle-part configuration of an encoding-side terminal according to Embodiment 2 of the present invention (the present terminal)

FIG. 7 is a block diagram illustrating a principle-part configuration of an encoding-side terminal of the present embodiment (the present terminal). It should be noted that FIG. 7 shows constituent parts concerning encoding, but does not show nor explain constituent parts concerning decoding for the sake of simplifying the explanation. Further, the same constituent portions of encoding section 210 of FIG. 7 as those of encoding section 110 of FIG. 3 are denoted with the same reference numerals as those of FIG. 3, and description thereabout is omitted.

Addition section 211 adds a predicted R signal and a decoded error R signal, generates a decoded R signal.

Stereo sense change detecting section 212 uses the decoded L signal and the decoded R signal to determine whether the sense of stereo changes or not. When the sense of stereo changes, stereo sense change detecting section 212 turns on switch 213, and stores the filter coefficients of adaptive filter 115 to buffer 114. On the other hand, when the sense of stereo does not change, stereo sense change detecting section 212 turns off switch 213.

For example, a method for detecting change of the sense of stereo may include obtaining the amount of change of energy ratio between the decoded L signal and the decoded R signal and detecting presence/absence of change of the sense of stereo in accordance with comparison result between the amount of change and a predetermined threshold value. For example, stereo sense change detecting section 212 determines that the sense of stereo changes when the amount of change of energy ratio is more than the predetermined threshold value. In this case, the change of the sense of stereo over time can be detected with a small amount of operation.

Alternatively, stereo sense change detecting section 212 calculates a cross-correlation function between the decoded L signal and the decoded R signal, and detects presence/absence of change of the sense of stereo in accordance with the comparison result between the predetermined threshold value and the amount of change of phase difference at which the cross-correlation function yields the maximum value. For example, when the amount of change of the phase difference is more than the predetermined threshold value, stereo sense change detecting section 212 determines that the sense of stereo changes. In this case, stereo sense change detecting section 212 can detect the change of the sense of stereo over time with a small amount of operation.

Figure 8:
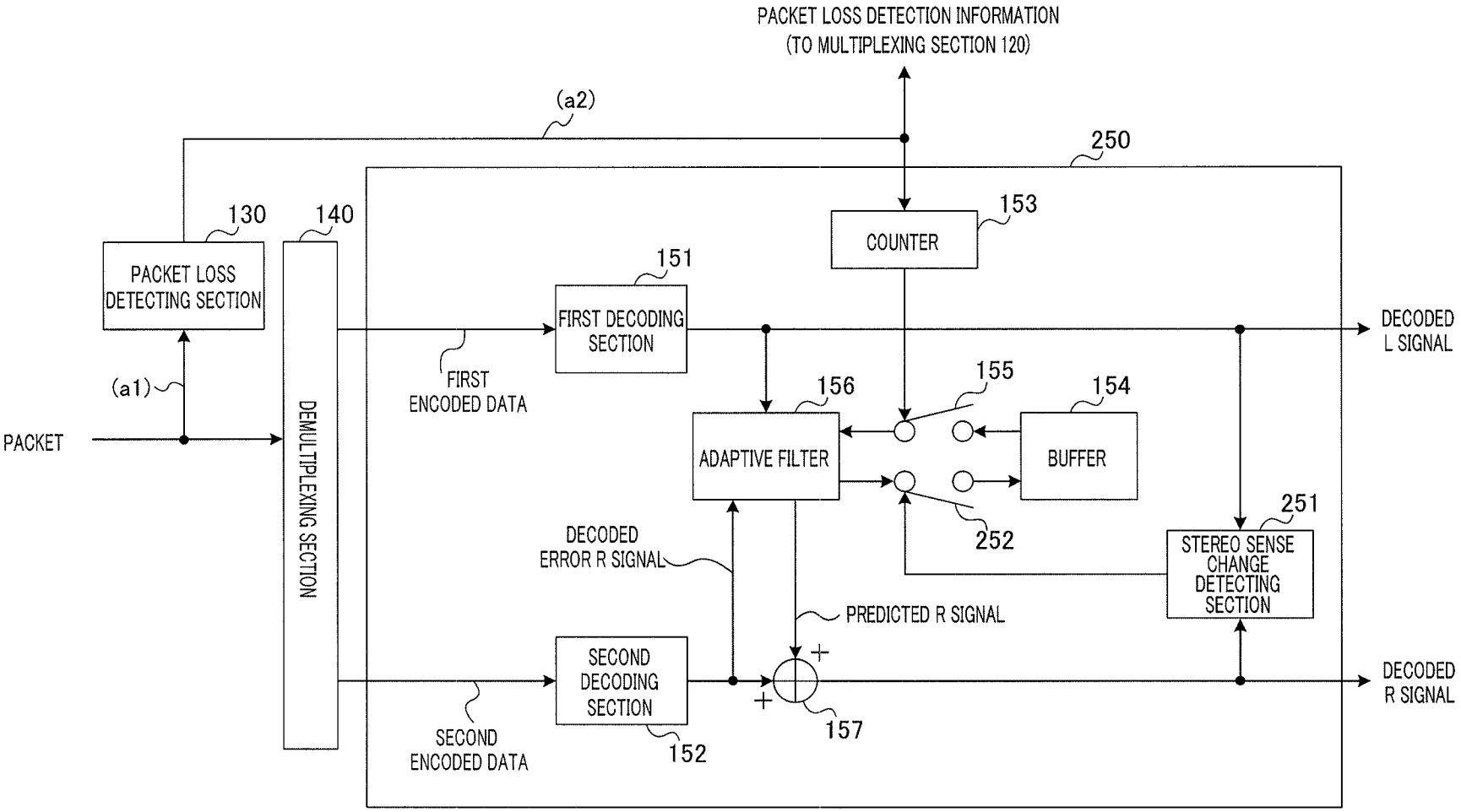
FIG. 8 is a block diagram illustrating a principle-part configuration of a decoding-side terminal according to Embodiment 2 (opposite terminal)

FIG. 8 is a block diagram illustrating a principle-part configuration of a decoding-side terminal according to present embodiment (opposite terminal). It should be noted that FIG. 8 shows constituent parts concerning decoding, but does not show nor explain constituent parts concerning encoding for the sake of simplifying the explanation. Further, the same constituent portions of decoding section 250 of FIG. 8 as those of decoding section 150 of FIG. 4 are denoted with the same reference numerals as those of FIG. 4, and description thereabout is omitted.

Like stereo sense change detecting section 212, stereo sense change detecting section 251 uses the decoded L signal and the decoded R signal to determine whether the sense of stereo changes or not. When the sense of stereo changes, stereo sense change detecting section 251 turns on switch 252, and stores the filter coefficients of adaptive filter 156 to buffer 154. On the other hand, when the sense of stereo does not change; stereo sense change detecting section 251 turns off switch 252.

As described above, in present embodiment, the filter coefficients are stored to buffer 114 and buffer 154 when the sense of stereo changes over time.

Figure 9:
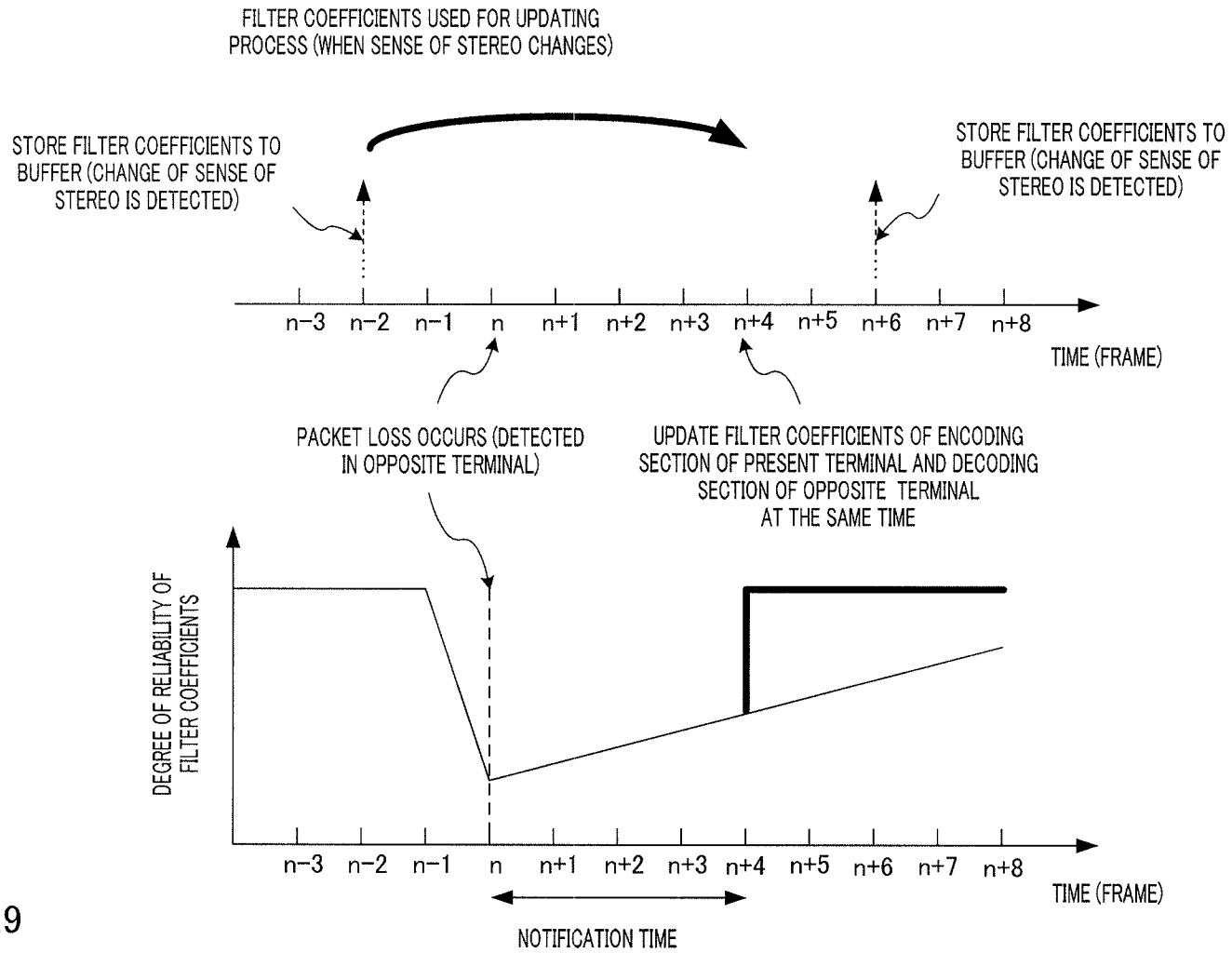
FIG. 9 is a figure for explaining a method for replacing filter coefficients of an adaptive filter according to Embodiment 2.

Subsequently, the method for replacing the filter coefficients of adaptive filter 115 and adaptive filter 156 according to present embodiment will be explained. In the explanation below, for example, as shown in FIG. 9, change of the sense of stereo is detected in the (n−2)-th frame and the (n+6)-th frame.

As described above, the filter coefficients of the (n+6)-th frame and the (n−2)-th frame at which change of the sense of stereo is detected are stored to the buffer. As a result, the filter coefficients for the (n−2)-th frame at which the sense of stereo changed are held in the buffer up to the (n+6)-th frame at which change of the sense of stereo is subsequently detected.

At this occasion, when packet loss occurs in the n-th frame, ordinary processing is performed on the n-th frame to the (n+3)-th frame, i.e., $N_X$ (=4) frames since the packet loss occurs. At the (n+4)-th frame, the filter coefficients of adaptive filter 115 of the present terminal and adaptive filter 156 of the opposite terminal are replaced with the filter coefficients stored in buffers 114, 154.

As a result, in the (n+5)-th frame and subsequent frames, synchronization can be made between adaptive filters 115, 156 of the present terminal at the encoding side and the opposite terminal at the decoding side, and this can suppress deterioration of sound quality.

Since buffers 114, 154 always hold the filter coefficients at which the sense of stereo changes, deterioration of sound quality does not occur even when the filter coefficient stored in buffers 114, 154 are used.

In Embodiment 1, a plurality of frames is required for the memory capacities of buffers 114, 154. In present embodiment, however, it is sufficient for the memory regions of buffers 114, 154 to hold the filter coefficients of adaptive filters 115, 156 for only one frame. Present Embodiment requires less memory capacity than Embodiment 1.

In present embodiment, the processing for storing the filter coefficients to buffers 114, 154 may be performed only when the sense of stereo changes. When the sound source is fixed, the sense of stereo does not change greatly. When the sound source moves, or when a new sound source is added, the sense of stereo greatly changes. Therefore, the processing for storing the filter coefficients to buffers 114, 154 is performed only when the sound source moves or a new sound source is added. For example, in application such as TV conference, movement of the sound source, addition of a new sound source, and the like occur once in several seconds to several dozen seconds. Once the sense of stereo changes, the sense of stereo is maintained for a relatively long time. Therefore, by making use of the features of the sense of stereo, the filter coefficients are stored to buffers 114, 154 only when the sense of stereo changes. Accordingly, the filter coefficients are subsequently stored to buffers 114, 154 several seconds to several dozen seconds later. Therefore, as compared with Embodiment 1, the amount of processing required to store the filter coefficients to buffers 114, 154 can be reduced.

In addition, every time the sense of stereo changes, buffers 114, 154 store the filter coefficients on every such occasion. Therefore, buffers 114, 154 always hold the filter coefficients when the sense of stereo changes. Therefore, even when adaptive filters 115, 156 use the filter coefficients stored in buffers 114, 154, the sense of stereo is maintained, so that the sound quality is not deteriorated.

Embodiment 3

In the explanation about Embodiment 2, presence/absence of change of the sense of stereo is detected using the amount of change of the phase difference when the amount of change of energy ratio between the decoded L signal and the decoded R signal or the cross-correlation function between the decoded L signal and the decoded R signal attains the maximum value. Only when the sense of stereo changes, the filter coefficients of the adaptive filters are stored to the buffer.

In the explanation about present embodiment, presence/absence of change of the sense of stereo is detected using the amount of change of the filter coefficients of the adaptive filters over time as the sense of stereo. More specifically, the position of filter coefficients having the largest amplitude is obtained from among the filter coefficients of the adaptive filters, and when the obtained position greatly changes over time, the change is deemed to be change of the sense of stereo, and the filter coefficients are stored to the buffer. In present embodiment, change of the sense of stereo can be detected without generating any decoded R signal. Therefore, the advantages of the present invention can be obtained while better suppressing the increase in the amount of operation than Embodiment 2.

Figure 10:
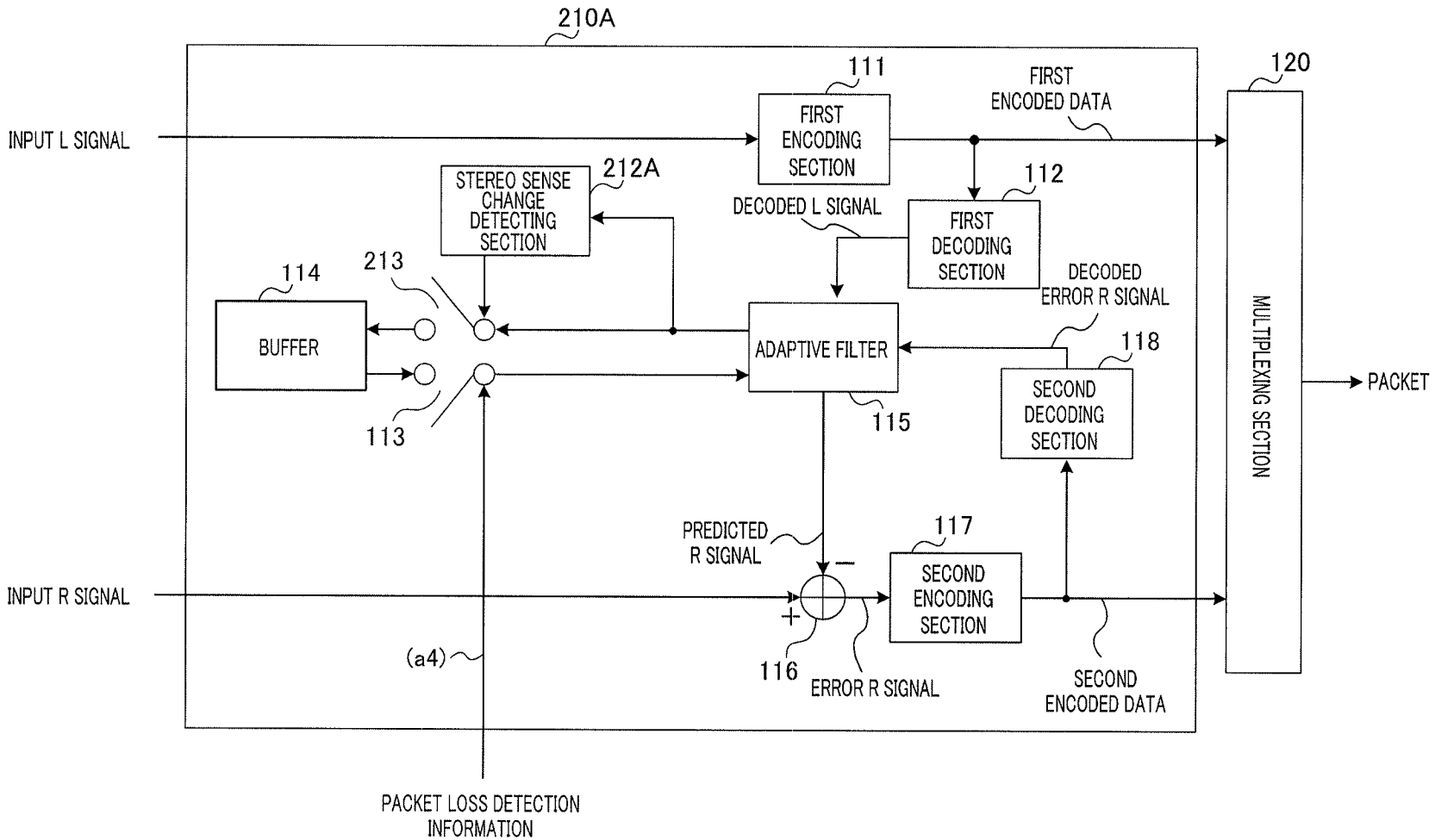
FIG. 10 is a block diagram illustrating a principle-part configuration of an encoding-side terminal according to Embodiment 3 of the present invention (the present terminal)

FIG. 10 is a block diagram illustrating a principle-part configuration of an encoding-side terminal according to present embodiment of the present invention (the present terminal). It should be noted that FIG. 10 shows constituent parts concerning encoding, but does not show nor explain constituent parts concerning decoding for the sake of simplifying the explanation. Further, the same constituent portions of encoding section 210A of FIG. 10 as those of encoding section 210 of FIG. 7 are denoted with the same reference numerals as those of FIG. 7, and description thereabout is omitted.

Stereo sense change detecting section 212A uses the filter coefficients of adaptive filter 115 to detect presence/absence of change of the sense of stereo. When the sense of stereo changes, switch 213 is turned on, and the filter coefficients of adaptive filter 115 are stored to buffer 114. On the other hand, when the sense of stereo does not change, stereo sense change detecting section 212A turns off switch 213.

More specifically, stereo sense change detecting section 212A uses equation 6 to calculate coefficient energy of the filter coefficient.

[6]

$$E_g(n)=|g_k(n)|^2 \quad \text{(Equation 6)}$$

In equation 6, $E_g(n)$ denotes the coefficient energy of the filter coefficient $g_k(n)$.

Stereo sense change detecting section 212A obtains a filter coefficient order n at which the coefficient energy $E_g(n)$ yields the maximum value, and calculates the amount of change between the frames of the filter coefficient n. Then, stereo sense change detecting section 212A determines that the sense of stereo has changed when the amount of change is more than a predetermined threshold value. As a result, switch 213 is turned on, and the filter coefficients of adaptive filter 115 are stored to buffer 114.

It should be noted that stereo sense change detecting section 212A may not use the coefficient energy $E_g(n)$ as it is, an may be configured to obtain a mean value of the coefficient energy of the filter coefficient orders ranging over a plurality of filter coefficient orders around the filter coefficient order n and obtain the filter coefficient order n at which the mean coefficient energy becomes the maximum value. For example, equation 7 shows a calculation equation of average coefficient energy $E_{avg}(n)$ when stereo sense change detecting section 212A obtains the mean value of coefficient energy $E_g(n)$ ranging over two filter coefficient orders around the filter coefficient order n.

(Equation 7)

$$E_{avg}(n) = \sum_{i=-2}^{2} |g_k(n+i)|^2 \quad [7]$$

Figure 11:
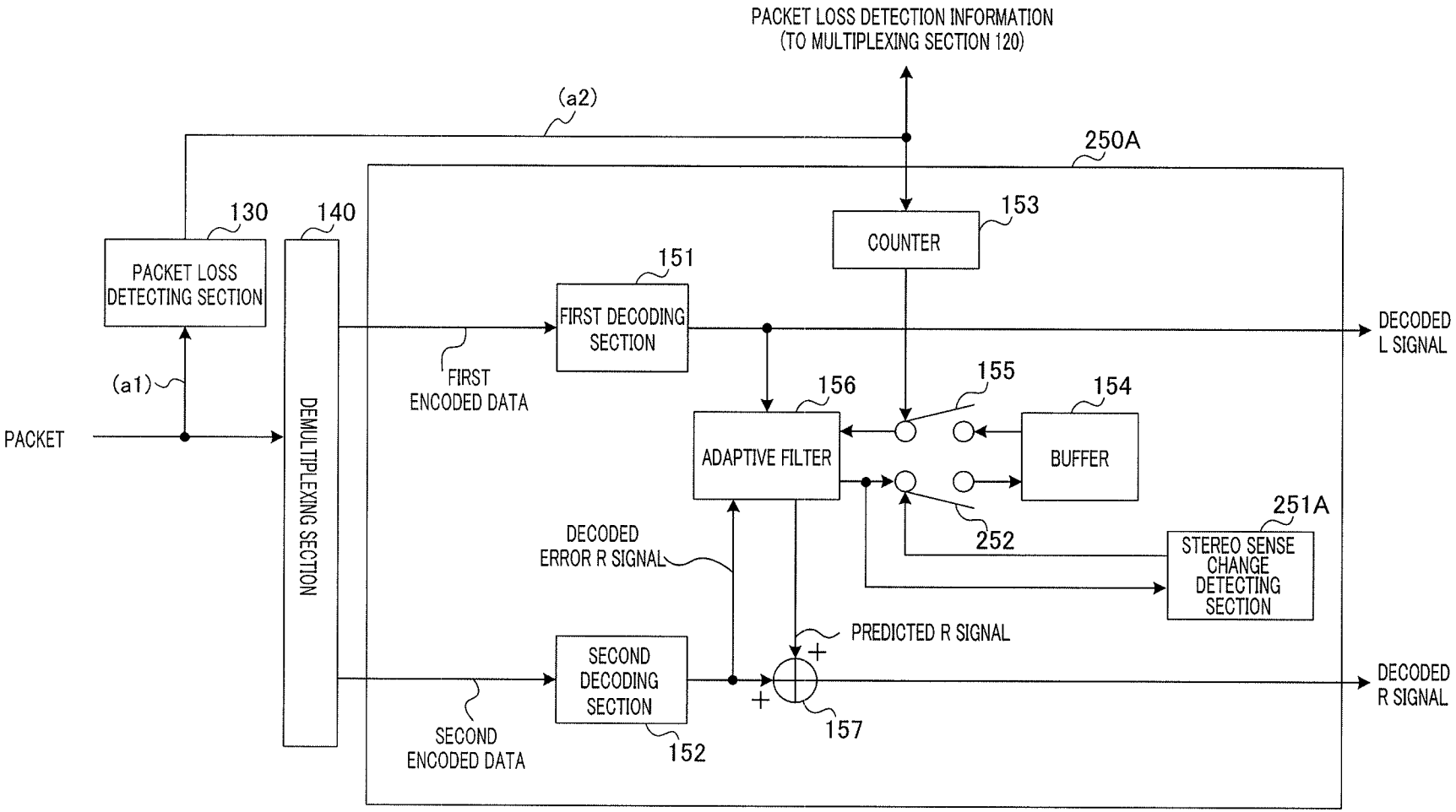
FIG. 11 is a block diagram illustrating a principle-part configuration of a decoding-side terminal according to Embodiment 3 (opposite terminal).

FIG. 11 is a block diagram illustrating a principle-part configuration of a decoding-side terminal according to present embodiment (opposite terminal). It should be noted that FIG. 11 shows constituent parts concerning decoding, but does not show nor explain constituent parts concerning encoding for the sake of simplifying the explanation. Further, the same constituent portions of decoding section 250A of FIG. 11 as those of decoding section 250 of FIG. 8 are denoted with the same reference numerals as those of FIG. 8, and description thereabout is omitted.

Stereo sense change detecting section 251A uses the filter coefficients of adaptive filter 156 to determine whether the sense of stereo changes or not. When the sense of stereo changes, stereo sense change detecting section 251A turns on switch 252, and stores the filter coefficients of adaptive filter 156 to buffer 154. On the other hand, when the sense of stereo does not change; stereo sense change detecting section 251A turns off switch 252. It should be noted that the detection method is the same as the detection method of stereo sense change detecting section 212A of encoding section 210A, and therefore description thereabout is omitted here.

As described above, in present embodiment, stereo sense change detecting section 212A and stereo sense change detecting section 251A detect presence/absence of change of the sense of stereo in accordance with comparison result between the predetermined threshold value and the amount of change of the filter coefficient order at which the coefficient energy of the filter coefficient becomes the largest, and when the sense of stereo changes over time, the filter coefficients are stored to buffer 114 and buffer 154.

Therefore, like Embodiment 1, desynchronization of the adaptive filters of the encoding-side terminal and the decoding-side terminal caused by transmission error can be solved in a short time, and prolonged displacement of the filter coefficients can be prevented. As a result, deterioration of sound quality can be suppressed, and this can achieve reduction of the amount of processing required to store the filter coefficients to the buffer and reduction of the amount of memory capacity of the buffer.

Embodiments of the present invention have been hereinabove explained.

In the above explanation, packet loss is detected as transmission error. Alternatively, bit error may be detected.

In the above explanation, the method for in-band transmission of notification of the packet loss detection information from the opposite terminal to the present terminal has been explained. However, Embodiments are not limited thereto. Alternatively, a method for out-band transmission of notification of the packet loss detection information may be employed. In in-band transmission, a packet including the packet loss detection information is generated and transmitted. In out-band transmission, communication system control information including the packet loss detection information is generated and transmitted.

In FIG. 2, the notification of the packet loss detection information transmitted from terminal #2 to terminal #1 using signal line (a3) may be deemed as the notification of the packet loss detection information transmitted from terminal #1 to terminal #2 using signal line (b3), and the filter coefficients of adaptive filters 156, 115 of decoding section 150 of terminal #1 and encoding section 110 of terminal #2 may be replaced with the filter coefficients of the past. Terminal #1 and terminal #2 communicate with each other in both directions, and propagation environment between terminal #1 and terminal #2 is considered to be substantially constant in a short period of time. Therefore, when terminal #2 detects packet loss of packets transmitted from terminal #1, it is highly possible that terminal #1 also detects packet loss of packets transmitted from terminal #2. Therefore, when terminal #2 detects packet loss of packets transmitted from terminal #1, terminal #2 may deem that terminal #1 also detects packet loss, and may replace the filter coefficients of the adaptive filter at the encoding side of terminal #2 and the adaptive filter at the decoding side of terminal #1 with the filter coefficients of the past at the same time when replacing the filter coefficients of the adaptive filter at the decoding side of terminal #2 and the adaptive filter at the encoding side of terminal #1 with the filter coefficients of the past. As a result, it is not necessary to transmit notification of the packet loss detection information from terminal #1 to terminal #2 and from terminal #2 to terminal #1, and therefore, increase in the amount of signaling can be avoided.

In the above explanation, for example, the stereo audio signal (two channel signal) has been explained. However, the present invention can also be applied to the multi-channel audio signal in the same manner. Alternatively, it is to be understood that the input R signal may be a channel used for prediction, and the input L signal may be a predicted channel.

In the above explanation, the use of NLMS (Normalized Least Mean Square) method has been explained as the method for updating the filter coefficients of the adaptive filters. However, other update methods such as LMS (Least Mean Square) method, projection method, RLS (Recursive Least Squares) method may also be applied.

In the above explanation, for example, the packet communication system has been explained. However, present invention is not limited thereto. The present invention may also be applied to a line switching communication system.

In the above explanation, for example, the communication terminal apparatus has the configuration shown in each Embodiment. Alternatively, the base station apparatus may have the configuration shown in each Embodiment.

The above explanations are examples of preferred Embodiments of the present invention, and the scope of the present invention is not limited thereto. The present invention can also be applied to any system having an encoding apparatus and a decoding apparatus.

The encoding apparatus and the decoding apparatus according to the present invention may be incorporated into, for example, a communication terminal apparatus and a base station apparatus in a mobile communication system as a voice encoding apparatus and a voice decoding apparatus. Accordingly, the communication terminal apparatus, the base station apparatus, and the mobile communication system capable of achieving the same actions and effects as above can be provided.

Also, although cases have been described with the above embodiment as examples where the present invention is configured by hardware, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2009-124592, filed on May 22, 2009, including the specification, drawings, and abstract, is incorporated herein by reference in its entirety.

INDUSTRIAL APPLICABILITY

The encoding apparatus, the decoding apparatus, and the like according to the present invention are suitable for the use in portable telephone, IP telephone, television conference, and the like.

REFERENCE SIGNS LIST

100 Terminal
110, 210, 210A Encoding section
111 First encoding section
112, 151 First decoding section
113, 155, 213, 252 Switch
114, 154 Buffer
115, 156 Adaptive filter
116 Subtraction section
117 Second encoding section
118, 152 Second decoding section
120 Multiplexing section
130 Packet loss detecting section
140 Demultiplexing section
150, 250, 250A Decoding section
153 Counter
157, 211 Addition section
212, 212A, 251, 251A Stereo sense change detecting section

The invention claimed is:

1. An encoding apparatus, comprising:

a first encoder that generates first encoded information by encoding a first channel signal;

a first decoder that generates a first decoded signal by decoding the first encoded information;

an adaptive filter that performs filter processing on the first decoded signal and generates a predicted signal of a second channel signal;

an error signal generator that generates an error signal by obtaining an error between the second channel signal and the predicted signal;

a second encoder that generates second encoded information by encoding the error signal;

a second decoder that generates a decoded error signal by decoding the second encoded information;

a storage that stores filter coefficients used in the filter processing;

a first switch that switches a connection state from the storage to the adaptive filter, based on first detection information indicating presence/absence of transmission error, wherein the adaptive filter uses the first decoded signal and the decoded error signal to update the filter coefficients and, when the first switch connects the storage and the adaptive filter, the adaptive filter receives the filter coefficients of the past from the storage to use the filter coefficients of the past as the filter coefficients of the adaptive filter and performs the filter processing;

a change detector that detects presence/absence of change of a sense of stereo of the first channel signal and the second channel signal and generating second detection information; and a second switch that switches a connection state from the adaptive filter to the storage based on the second detection information, wherein:

when the second detection information indicates presence of change of the sense of stereo, the second switch-connects the adaptive filter and the storage; and when the second switch section connects the adaptive filter and the storage, the storage stores the filter coefficients updated in the adaptive filter.

2. The encoding apparatus according to claim 1, wherein, when the first detection information indicates presence of transmission error, the first switch connects the storage and the adaptive filter.

3. The encoding apparatus according to claim 1, wherein the adaptive filter receives, from the storage, filter coefficients of the past that are older by a number of frames set in advance based on a notification time required to transmit a notification of the first detection information from the other party in communication to the encoding apparatus.

4. The encoding apparatus according to claim 1, wherein, every time the filter coefficients are updated in the adaptive filter, the storage stores the updated filter coefficients.

5. The encoding apparatus according to claim 1, further comprising:

an adder that generates a second decoded signal by adding the decoded error signal and the predicted signal, wherein the change detector uses the first decoded signal and the second decoded signal to detect presence/absence of change of the sense of stereo.

6. The encoding apparatus according to claim 5, wherein the change detector detects presence/absence of change of the sense of stereo in accordance with at least one of a comparison result between a first predetermined threshold value and an amount of change of energy ratio between the first decoded signal and the second decoded signal, or a comparison result between a second predetermined threshold value and an amount of change of a phase difference at which a cross-correlation function between the first decoded signal and the second decoded signal yields a maximum value.

7. The encoding apparatus according to claim 1, wherein the change detector uses the filter coefficients of the adaptive filter to detect presence/absence of change of the sense of stereo.

8. The encoding apparatus according to claim 7, wherein the change detector detects presence/absence of change of the sense of stereo in accordance with a comparison result between a predetermined threshold value and an amount of change of a filter coefficient order at which the coefficient energy of the filter coefficient becomes the largest.

9. A communication terminal apparatus, comprising the encoding apparatus according to claim 1.

10. A base station apparatus, comprising the encoding apparatus according to claim 1.

11. A decoding apparatus, comprising:

a first decoder that generates a first decoded signal by decoding first encoded information relating to a first channel signal;

a second decoder that generates a decoded error signal by decoding second encoded information relating to a second channel signal;

an adaptive filter that generates the predicted signal by performing filter processing on the first decoded signal and uses the first decoded signal and the decoded error signal to update filter coefficients used in the filter processing;

a storage that stores the filter coefficients;

a detector that detects presence/absence of transmission error and generates a detection result as first detection information;

a measurer that counts an elapsed time since the detection result indicated that presence of transmission error was detected; and a first switch that connects the storage and the adaptive filter when the elapsed time matches a predetermined time;

wherein, when the first switch connects the storage and the adaptive filter, the adaptive filter receives filter coefficients of the past from the storage and performs the filter processing using the filter coefficients of the past as the filter coefficients of the adaptive filter;

a change detector section that detects presence/absence of change of a sense of stereo of the first channel signal and the second channel signal and generates second detection information; and a second switch that switches a connection state from the adaptive filter to the storage based on the second detection information, wherein:

when the second detection information indicates presence of change of the sense of stereo, the second switch connects the adaptive filter and the storage; and when the second switch connects the adaptive filter and the storage, the storage stores the filter coefficients updated in the adaptive filter.

12. The decoding apparatus according to claim 11, wherein, when the elapsed time matches a time set in advance based on a notification time required to transmit a notification of the first detection information to the other party in communication from the decoding apparatus, the first switch connects the storage and the adaptive filter, and the adaptive filter receives, from the storage, filter coefficients of the past that are older by a number of frames set in advance based on the notification time.

13. The decoding apparatus according to claim 11, further comprising: an adder that generates a second decoded signal by adding the decoded error signal and the predicted signal, wherein the change detector uses the first decoded signal and the second decoded signal to detect presence/absence of change of the sense of stereo.

14. The decoding apparatus according to claim 13, wherein the change detector detects presence/absence of change of the sense of stereo in accordance with at least one of a comparison result between a first predetermined threshold value and an amount of change of energy ratio between the first decoded signal and the second decoded signal, or a comparison result between a second predetermined threshold value and an amount of change of a phase difference at which a cross-correlation function between the first decoded signal and the second decoded signal yields a maximum value.

15. The decoding apparatus according to claim 11, wherein the change detector uses the filter coefficients of the adaptive filter to detect presence/absence of change of the sense of stereo.

16. The decoding apparatus according to claim 15, wherein the change detector detects presence/absence of change of the sense of stereo in accordance with a comparison result between a predetermined threshold value and an amount of change of a filter coefficient order at which the coefficient energy of the filter coefficient becomes the largest.

17. A communication terminal apparatus, comprising the decoding apparatus according to claim 11.

18. A base station apparatus, comprising the decoding apparatus according to claim 11.

19. An encoding method, comprising:

generating first encoded information by encoding a first channel signal;

generating a first decoded signal by decoding the first encoded information;

performing filter processing on the first decoded signal with an adaptive filter and generating a predicted signal of the second channel signal;

generating an error signal by obtaining an error between the second channel signal and the predicted signal;

generating second encoded information by encoding the error signal;

generating a decoded error signal by decoding the second encoded information;

using the first decoded signal and the decoded error signal to update the filter coefficients of the adaptive filter; and storing the updated filter coefficients to a memory;

first switching, by a first switch, a connection state from the memory to the adaptive filter, based on first detection information indicating presence/absence of transmission error, wherein, when the memory and the adaptive filter are connected in the first switching step, the adaptive filter receives the filter coefficients of the past from the memory to use the filter coefficients of the past as the filter coefficients of the adaptive filter and performs the filter processing;

detecting presence/absence of change of a sense of stereo of the first channel signal and the second channel signal and generating second detection information; and second switching, by a second switch, a connection state from the adaptive filter to the memory based on the second detection information, wherein:

when the second detection information indicates presence of change of the sense of stereo, the second switch connects the adaptive filter and the memory; and when the second switch connects the adaptive filter and the memory, the memory stores the filter coefficients updated in the adaptive filter.

20. A decoding method, comprising:

generating a first decoded signal by decoding first encoded information relating to a first channel signal;

generating a decoded error signal by decoding second encoded information relating to a second channel signal;

generating the predicted signal by performing filter processing on the first decoded signal with an adaptive filter and uses the first decoded signal and the decoded error signal to update filter coefficients used in the filter processing; and storing the updated filter coefficients to a memory;

detecting presence/absence of transmission error and generating detection result as first detection information;

counting an elapsed time since the detection result indicated that presence of transmission error was detected; and first switching, by a first switch, a connection of connecting the memory and the adaptive filter when the elapsed time matches a predetermined time, wherein, when the memory and the adaptive filter are connected in the first switching step, the adaptive filter receives the filter coefficients of the past from the memory to use the filter coefficients of the past as the filter coefficients of the adaptive filter and performs the filter processing;

in the filtering step detecting presence/absence of change of a sense of stereo of the first channel signal and the second channel signal and generates second detection information; and second switching, by a second switch, a connection state from the adaptive filter to the memory based on the second detection information, wherein:

when the second detection information indicates presence of change of the sense of stereo, the second switch connects the adaptive filter and the memory; and when the second switch connects the adaptive filter and the memory, the memory stores the filter coefficients updated in the adaptive filter.

* * * * *